US010247382B2

(12) United States Patent
Hager et al.

(10) Patent No.: US 10,247,382 B2
(45) Date of Patent: Apr. 2, 2019

(54) LIGHTING DEVICE WITH A LUMINESCENT MATERIAL

(71) Applicant: OSRAM GmbH, Munich (DE)

(72) Inventors: Juergen Hager, Herbrechtingen (DE); Stephan Schwaiger, Ulm (DE); Jasmin Muster, Heidenheim (DE); Oliver Hering, Niederstotzingen (DE)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 15/536,720

(22) PCT Filed: Dec. 10, 2015

(86) PCT No.: PCT/EP2015/079253

§ 371 (c)(1),
(2) Date: Jun. 16, 2017

(87) PCT Pub. No.: WO2016/096602

PCT Pub. Date: Jun. 23, 2016

(65) Prior Publication Data

US 2017/0350569 A1 Dec. 7, 2017

(30) Foreign Application Priority Data

Dec. 19, 2014 (DE) ..... 10 2014 226 668

(51) Int. Cl.
*F21S 41/32* (2018.01)
*F21S 41/24* (2018.01)
(Continued)

(52) U.S. Cl.
CPC ..... *F21S 41/32* (2018.01); *F21S 41/14* (2018.01); *F21S 41/16* (2018.01); *F21S 41/24* (2018.01);
(Continued)

(58) Field of Classification Search
None
See application file for complete search history.

(56) References Cited

U.S. PATENT DOCUMENTS

2005/0243570 A1* 11/2005 Chaves ..... G02B 19/0023 362/551
2009/0251915 A1* 10/2009 Boroczki ..... F21S 41/689 362/512
(Continued)

FOREIGN PATENT DOCUMENTS

DE 19860669 A1 7/2000
DE 10347951 A1 5/2005
(Continued)

OTHER PUBLICATIONS

German Search Report based on application No. 10 2014 226 668.8 (8 pages) dated Jul. 24, 2015 (for reference purpose only).
(Continued)

*Primary Examiner* — Elmito Breval
(74) *Attorney, Agent, or Firm* — Viering, Jentschura & Partner MBB

(57) ABSTRACT

A lighting device is disclosed with an electromagnetic radiation source for irradiating a conversion element arranged in the lighting device with an excitation radiation. The conversion element has a first element side and a second element side. The first element side delimits a first radiation space and the second element side delimits a second radiation space. At least one optical unit at least for part of the radiation emanating from the first element side is arranged in the first radiation space and at least one optical unit at least for part of the radiation emanating from the second element side is arranged in the second radiation space.

15 Claims, 6 Drawing Sheets

(51) Int. Cl.

| | |
|---|---|
| ***F21S 41/14*** | (2018.01) |
| ***F21S 41/689*** | (2018.01) |
| ***F21S 41/663*** | (2018.01) |
| ***F21S 43/33*** | (2018.01) |
| ***F21S 41/37*** | (2018.01) |
| ***F21S 43/00*** | (2018.01) |
| ***F21S 41/16*** | (2018.01) |
| *H01R 33/00* | (2006.01) |
| *F21S 41/20* | (2018.01) |

(52) U.S. Cl.

CPC ..... *F21S 41/37* (2018.01); *F21S 41/663* (2018.01); *F21S 41/689* (2018.01); *F21S 43/00* (2018.01); *F21S 43/33* (2018.01); *F21S 41/285* (2018.01); *F21S 41/321* (2018.01); *F21S 41/322* (2018.01)

(56) References Cited

U.S. PATENT DOCUMENTS

| | | | |
|---|---|---|---|
| 2010/0226142 | A1 | 9/2010 | Brendle et al. |
| 2012/0026721 | A1 | 2/2012 | Kurt et al. |
| 2012/0206900 | A1 | 8/2012 | Yang et al. |
| 2013/0194551 | A1 | 8/2013 | Zhang et al. |
| 2013/0314896 | A1 | 11/2013 | Finsterbusch |
| 2015/0070929 | A1 | 3/2015 | Weissenberger et al. |

FOREIGN PATENT DOCUMENTS

| | | | |
|---|---|---|---|
| DE | 102009008631 | A1 | 8/2010 |
| DE | 102009012138 | A1 | 9/2010 |
| DE | 102010062463 | A1 | 6/2012 |
| DE | 102011003665 | A1 | 8/2012 |
| DE | 102012206394 | A1 | 10/2013 |
| EP | 2511602 | A2 | 10/2012 |
| EP | 2541130 | A2 | 1/2013 |
| WO | 2009112961 | A1 | 9/2009 |

OTHER PUBLICATIONS

International Search Report based on application No. PCT/EP2015/079253 (15 pages) dated Mar. 21, 2016 (for reference purpose only).

* cited by examiner

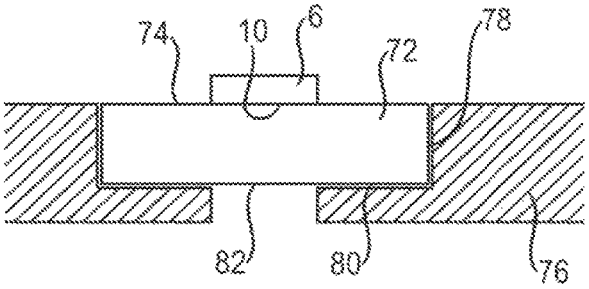
Fig. 16A
Fig. 16B
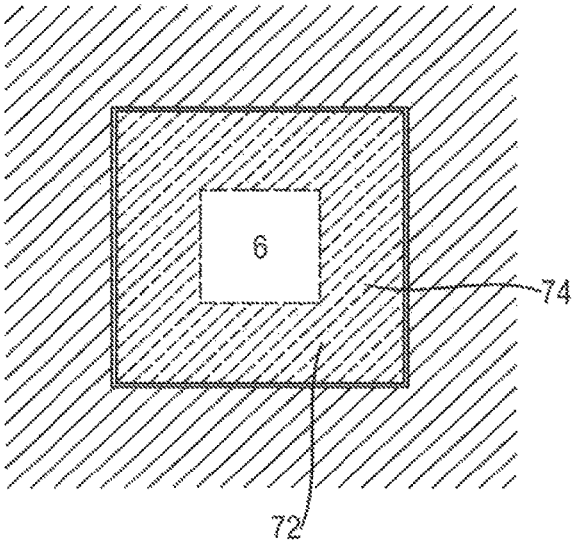
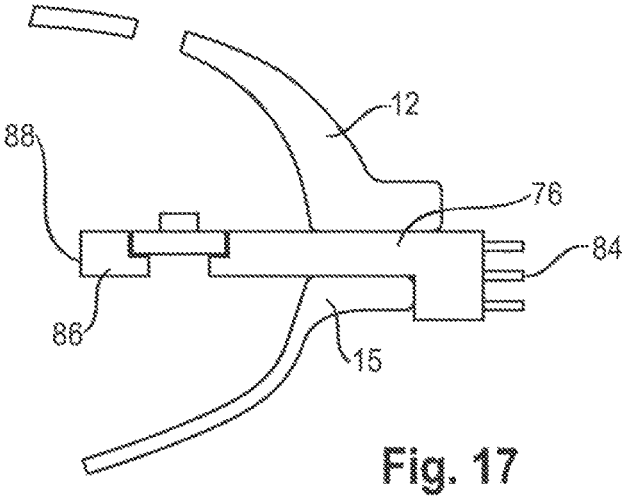
Fig. 17

LIGHTING DEVICE WITH A LUMINESCENT MATERIAL

RELATED APPLICATIONS

The present application is a national stage entry according to 35 U.S.C. § 371 of PCT application No.: PCT/EP2015/079253 filed on Dec. 10, 2015, which claims priority from German application No.: 10 2014 226 668.8 filed on Dec. 19, 2014, and is incorporated herein by reference in its entirety.

TECHNICAL FIELD

The present disclosure is based on a lighting device comprising an electromagnetic radiation source for irradiating a conversion element with an excitation radiation, in particular in the automotive sector.

BACKGROUND

LARP (Laser Activated Remote Phosphor) technology is known from the prior art. Here a conversion element is irradiated with an excitation beam (pump beam, pump laser beam) by an electromagnetic radiation source. The conversion element here includes or consists of a phosphor. The radiation source is a laser light source or a light emitting diode (LED). Excitation radiation incident in the conversion element is at least partly absorbed and at least partly converted into conversion radiation (emission radiation). The wavelength and thus the spectral properties and/or a color of the conversion radiation are/is determined in particular by the phosphor. The conversion radiation is emitted in all spatial directions. If full conversion is not present, (at least in part, depending on the layer thickness and concentration of scattering centers of the conversion element) the non-converted excitation radiation is also emitted or scattered in all spatial directions. The emission radiation emitted from an element side is usually used further by an optical unit (optical component).

If the phosphor of the conversion element is applied to a (diffusely) reflective support, then LARP technology can be used in a reflective embodiment. As a result, both a converted excitation radiation and a scattered excitation radiation that penetrates through the phosphor are then reflected back from the reflective support into the phosphor and "recycled". In contrast to this reflective embodiment, in the case of a transmissive arrangement of the phosphor, use is often made of a dichroic mirror provided in the beam path between the radiation source and the conversion element (advantageously as near as possible to the conversion element). The excitation radiation can penetrate through said dichroic mirror, which has a reflective effect for the conversion radiation, that is to say for radiation in converted wavelength ranges. As a result, a "recycling" effect can be achieved in the transmissive embodiment, too.

What is disadvantageous about the cited LARP technology is the comparatively low luminous efficiency.

SUMMARY

The object of the present disclosure is to provide a lighting device including a conversion element and an electromagnetic radiation source which has a high luminous efficiency.

This object is achieved by means of a lighting device in accordance with the features of claim 1.

Particularly advantageous configurations can be found in the dependent claims.

According to the present disclosure, a remote phosphor lighting device including an electromagnetic radiation source is provided. The radiation source serves for irradiating a conversion element with an excitation radiation (excitation beam, pump beam, pump laser beam). The conversion element of the lighting device has a first and a second element side. In this case, the element sides advantageously face away from one another. The first element side can delimit a first radiation space (half-space), and the second element side can delimit a second radiation space (half-space). Advantageously at least one optical unit or optical component for the radiation emanating from the first element side is arranged in the first radiation space and at least one optical unit or optical component at least for the radiation emanating from the second element side is arranged in the second radiation space.

This solution has the advantage that the "natural" propagation of a conversion radiation and possibly of the scattered excitation radiation is used by both radiation spaces respectively for an illumination purpose. In contrast to the prior art explained in the introduction, therefore, the conversion radiation and the scattered excitation radiation are not deflected or recovered by a complex and cost-intensive construction, such as, for example, with a dichroic mirror in the case of a transmissive technology. According to the present disclosure, now both element sides of the conversion element or of the conversion dye layer are regarded respectively as an optical emitter, even though from a physical standpoint only a single emitter is provided. Furthermore, according to the present disclosure, one or a plurality of downstream optical units are then used in order to utilize the radiation (light) emitted into both radiation spaces.

In a further configuration of the present disclosure, the radiation emanating from the element sides of the conversion element is coupled out by means of the optical units. The optical units are thus configured in such a way that the radiation is not or substantially not reflected back to the conversion element.

Advantageously, the radiation source is arranged in such a way that the excitation radiation radiates onto the first element side. In addition, a second radiation source can be provided, the excitation radiation of which radiates onto the second element side. Moreover it is possible to provide further radiation sources.

The element sides can be irradiated symmetrically or asymmetrically by the radiation sources, that is to say that the radiation sources are arranged symmetrically or asymmetrically with respect to the conversion element.

Advantageously, the conversion element can be inhomogeneous for setting a luminous flux and/or an angle distribution and/or a spectral composition. By way of example, on both element sides it is possible to use a different doping (conversion centers and/or scattering centers) at the surface and/or near to the surface. This can be effected statically or dynamically. It is likewise possible for the phosphor to have a different shape and/or thickness.

Both half-spaces can advantageously have a solid angle of approximately 2Π sr (steradians).

The radiation source can be a laser light source or a laser light source system. The laser light source may include for example a single laser diode or else a plurality of laser diodes with one or a plurality of possibly primary optical units. One optical unit or a plurality of primary optical units can thus be arranged in the beam path of the excitation radiation. Alternatively or additionally, it is conceivable to provide an optical waveguide (fiber, optical fiber) as radiation source (fiber-based system). By way of example, it is then conceivable that the laser light can be coupled into the optical waveguide in any desired manner.

Additionally or alternatively, other radiation sources can also be used, such as one or a plurality of light emitting diodes, for example, which can be focused onto the phosphor.

The excitation radiation is advantageously approximately parallelized relative to the distance between the radiation source and the conversion element. Alternatively, the excitation radiation can also be focused and thus have a focusing beam path with regard to the distance between the radiation source and the conversion element. In the case of a focusing, the conversion element can be arranged outside a focus of the excitation radiation, as a result of which it is not provided at the focus of the beam of rays. A size of a luminous spot can then advantageously be adjustable with the distance between the conversion element and the focus. It is conceivable here for the conversion element to be positioned both in the divergent and in the convergent section of the excitation radiation.

A size of the luminous spot (laser luminous spot) on the conversion element can have at least an extent or diameter of 20 μm for customary secondary optical units used (e.g. multifaceted freeform reflectors, lenses, primary collecting reflectors, TIR (Total Internal Reflection) collimators). Advantageously, a size of the luminous spot is between 50 and 500 μm—depending on the application and luminance requirements. If considerations regarding a luminance maximization are not of primary importance, a maximum extent of the luminous spot of up to 1000 μm is preferred. The stated values with regard to the luminous spot are advantageously provided for an irradiation with a laser diode and an impinging radiation power of 0.25 to 4 watts. For higher radiation powers it is also conceivable to use the stated values of the extent of the laser spot, wherein correspondingly higher luminances are achievable. It is also conceivable to use larger extents of the luminous spot with higher radiation powers, in particular a doubling of the area defined by the maximum extent in conjunction with a doubling of a radiation power. Furthermore, it is conceivable for luminous spots to be provided which are not rotationally symmetrical or have a greater extent in one direction than in another direction. A side-length or diameter ratio of such luminous spots is usually 1 as a minimum for the optical units mentioned above. Depending on an application, said ratio can also be 2 to 4 or a maximum of 5. The abovementioned sizes of the luminous spot are then intended to hold true for a small extent direction.

A reflector having an optical reflector surface can respectively be provided as optical unit for a respective element side. The excitation radiation converted and possibly scattered by the conversion element can thus be coupled into two optical reflector surfaces, which together advantageously generate a desired light distribution in a far field.

The reflector surfaces are arbitrarily adaptable with regard to the application in which they are used. This can be effected analytically, as a result of which said reflector surfaces can be configured for example parabolically or elliptically. It would also be conceivable to provide a freeform shape, such as a multifaceted freeform shape, for example.

The first reflector assigned to the first element side is advantageously used for the radiation emanating from the first element side. The second reflector assigned to the second element side is then advantageously provided for the radiation emanating from the second element side. Consequently, the radiation emitted into one half-space is used by the reflector surface of one reflector, while the reflector surface of the other reflector is used for the radiation emitted into the other half-space.

Advantageously, the first reflector surface or a partial region of the light distribution in the far field that arises as a result of the first reflector surface can be adapted to a luminous flux and/or to an angle distribution and/or to a spectral composition of the radiation emanating from the first element side. Alternatively or additionally, the second reflector surface or a partial region of the light distribution in the far field that arises as a result of the second reflector surface can be adapted to a luminous flux and/or to an angle distribution and/or to a spectral composition of the radiation emanating from the second element side. If one radiation source is provided, then depending on the concentration of scattering centers (conversion centers) in the phosphor and depending on the thickness thereof the radiation emanating from the element side facing away from the radiation source may have a different luminous flux and/or a different angle distribution and/or a different spectral composition (and thus also a different color) in comparison with the radiation that emanates from the other element side. This can thus be taken into account or utilized in the application by the optical surfaces (reflector surfaces) being adapted thereto or the partial regions of the light distribution in the far field which are dependent on the reflector surfaces being correspondingly divided.

If two radiation sources, in particular two laser light sources or laser light source systems, are provided, then a more homogeneous volume illumination of the conversion element can be achieved. It is conceivable for the illumination of the conversion element by the two radiation sources to be effected symmetrically, such that the light emitted from the two element sides also has in each case an identical beam of rays with an identical luminous flux. Alternatively, the irradiation by the two radiation sources of the excitation radiation can also be effected asymmetrically in order to provide a difference in luminous flux and/or in angle distribution and/or in light color.

If a reflector is respectively provided for a respective element side of the conversion element, then it is conceivable to connect them mechanically or in terms of materials engineering or else to embody them in an integral fashion.

In a further configuration of the present disclosure, a surface normal of the first or second element side of the conversion element can be approximately parallel to the main beam direction of the assigned radiation source. In principle, the angle of incidence can also be varied and chosen optimally depending on the application or depending on spatial conditions. In particular, the angle can also be adapted to the light source used. It is also conceivable that, in the case of at least two radiation sources, the latter are arranged at a different angle with respect to the conversion element.

In a further configuration of the present disclosure, a shutter (shading element) can be provided. Said shutter can be arranged in the beam path of the radiation reflected by at least one reflector. Furthermore, it can be arranged in an intermediate plane of the lighting device or in direct proximity to the intermediate plane. As a result, the lighting device according to the present disclosure can be used as a traditional monoprojector, for example for a mobile low-beam light function (4Π double half-space radiation). The shutter can have an (upper) edge, the configuration of which provides a required bright-dark boundary. Furthermore, the reflector surfaces can be configured in such a way that they do not distribute the reflected radiation in the far field, but rather in the near field, namely advantageously in the intermediate plane. Advantageously, in a further configuration, the reflector surfaces are in this case designed in such a way, or configured in such a way, that as little radiation as possible impinges on the shutter. Downstream of the intermediate plane, an optical unit, in particular in the form of a lens, can be provided in order to image the radiation in the far field, as a result of which a desired low-beam light distribution can be realized on the road. It is also conceivable to provide a plurality of radiation sources (laser light sources or laser light source systems) for the embodiment with the shutter.

Advantageously, the shutter can be movable, for example pivotable. Consequently, it can be introduced into and withdrawn from the beam path of the radiation reflected by the reflectors. The movable shutter enables a dual light function, such as, for example, a low-beam light and a high-beam light.

Advantageously, the radiation emanating from the first element side is used for a light function, for example for a low-beam light, and the radiation emanating from the second element side is used for a further light function. Alternatively or additionally, the radiations emanating from both element sides can be used jointly for a further light function, such as a high-beam light, for example. Consequently, the reflector provided for the first element side can serve for example for the light distribution necessary for the low-beam light in the intermediate plane, wherein the lens disposed downstream of the intermediate plane can image the radiation reflected by said reflector into the far field. The other reflector can then use the radiation emanating from the second element side. It is also conceivable for the reflector assigned to the second element side to reflect the radiation emanating from the second element side for the first light function, for example for the low-beam light. Consequently, this reflector, at least in sections, can reflect radiation toward the intermediate plane, which lies outside or above the shutter when the latter is introduced into the beam path. Advantageously, however, the reflector of the second element side is configured in such a way that at least a large part of the radiation being reflected impinges on the shutter when the latter is in an introduced position (low-beam light). For a high-beam light, the shutter can then be withdrawn or switched over. As a result, additional radiation passes into the far field. Here, too, it is conceivable to provide one or a plurality of radiation sources.

Advantageously, a further shutter is provided. The latter is arranged for example horizontally and/or approximately parallel to a direction of travel of a vehicle using the lighting device. It can be arranged and/or embodied in such a way that the radiation that is reflected by the reflector for the first element side does not impinge on the other (first) shutter. The further (second) shutter can then reflect this radiation for example toward the intermediate plane, where it is correspondingly distributed in the lens disposed downstream of the intermediate plane in the far field. The efficiency of the lighting device increases as a result.

In an alternative embodiment, a, in particular single, shutter is provided, which is arranged in such a way that it at least substantially separates the respective radiation reflected by the reflectors from one another. Advantageously, the shutter in this case is fixed and advantageously arranged horizontally and/or approximately parallel to the direction of travel of the vehicle using the lighting device. The shutter can then likewise form a basis for the low-beam light, said shutter forming the bright-dark boundary in the intermediate plane. An optical unit can be disposed downstream of the intermediate plane, said optical unit being arranged in such a way that it substantially only uses the radiation emanating from the first element side. The radiation emanating from the second element side can then be imaged into the far field directly by the assigned reflector. The reflector is then a multifaceted freeform reflector, for example. The reflector surfaces together with the entire projection system can form the entire low-beam light distribution. It is also conceivable to provide a movable element which is arranged in the beam path of the radiation emanating from the second element side and is embodied in an absorbent fashion. It is thus possible for the element to be able to be introduced and withdrawn below the conversion element, for example. Consequently, different light functions can be provided with the reflector assigned to the first element side, on the one hand, and with the multifaceted freeform reflector, on the other hand.

In a further configuration of the present disclosure, the conversion element can be inclined relative to the reflector surfaces of the reflectors or relative to a horizontal plane or relative to the direction of travel. In a further configuration, both reflector surfaces can distribute the reflected radiation directly in the far field, without an optical unit being interposed. The reflector surfaces can thus both be embodied for example as multifaceted freeform surfaces. As a result of the inclination of the conversion element, in particular the reflector surface of the reflector assigned to the first element side can be irradiated more efficiently. This is advantageous particularly if the radiation of the first element side has a higher luminous flux proportion of the total luminous flux in comparison with the radiation of the second element side. It is conceivable for the reflector surface of the reflector for the first element side in the far field then to serve for the distribution of the radiation, for example in the form of a low-beam light. The reflector surface of the other reflector can then be used as support or for a further light function, for example for a road sign illumination function.

It would also be conceivable for the reflector surface of the reflector for the second element side in interaction with the other reflector surface also to form a high-beam light function. In this case, it is advantageous if a movable shutter is provided, which shields the radiation emanating from the second element side from the reflector for the second element side as long as the low-beam light function is required. In this case, the shutter can be embodied in an absorbent fashion or alternatively in a reflective fashion in order to "recycle" the radiation emanating from the second element side and to direct it to the reflector for the first element side and/or to the conversion element. It is advantageous if the shutter here has a concave shutter surface facing the conversion element. Furthermore, it is advantageous if the shutter is arranged as near as possible to the conversion element, such that it reflects substantially the entire radiation emanating from the first element side back to the phosphor. The radiation is thus additionally used for the light function of the reflector surface for the first element side. In order to use the further light function, such as the high-beam light function, for example, the shutter is withdrawn at least in sections from the beam path between the second element side and the reflector assigned thereto. Alternatively, it is conceivable for both reflector surfaces of the reflectors to generate in each case the part of a light function without a bright-dark boundary, or for different light functions to be realized with both of them, in particular with a shutter.

In an alternative embodiment of the lighting device, the first element side of the conversion element is assigned an optical unit in the form of the reflector and the second element side is assigned a refractive optical unit, in particular a lens. The latter then collects at least part of the radiation emanating from the second element side. A second reflector can thus be dispensed with. The light function formed by the reflector assigned to the first element side can be supported or supplemented by the refractive optical unit. In addition, it is conceivable to provide a movable shutter which can be introduced in between and withdrawn from between the second element side and the refractive optical unit. As an alternative to the lens, it is conceivable to use a refractive TIR (Total Internal Reflection) collimator optical unit. An exit surface of the TIR collimator optical unit can for example be plane or have a curvature or be embodied as a multifaceted freeform shape.

In a further embodiment of the lighting device, provision can be made for a CPC (Compound Parabolic Concentrator) optical unit to be assigned to one element side. The reflector can then be assigned as optical unit to the other element side. The CPC optical unit is advantageous for downstream optical units and light functions which are not luminance-oriented to such a great extent or for which a comparatively small solid angle is advantageous, such as, for example, in the case where a radiation is coupled into an optical waveguide.

In a further advantageous embodiment, an angle rotator can be provided directly on one or both element sides of the conversion element, in order to deflect the radiation in a compact space by approximately 90° or some other angle toward a downstream optical unit. Such angle rotators are disclosed for example in the document "Introduction to Nonimaging Optics", author Julio Chaves, published by CRC Press.

Advantageously, the conversion element can be arranged in such a way that the surface normals of the (substantially planar) element sides face approximately in the direction of travel and/or approximately in the horizontal direction. A reflector is provided here for one of the element sides, which reflector distributes the radiation directly in the far field. A refractive TIR collimator optical unit can be provided for the other element side. In this case, an exit surface of the TIR collimator optical unit can be configured as plane or curved or have in particular a multifaceted freeform shape. Alternatively, it is conceivable to replace the TIR collimator optical unit by a simple lens or a Fresnel optical unit.

In a further configuration of the lighting device including the conversion element whose surface normal points approximately in the direction of travel, the reflector surface of the reflector can be embodied in such a way that an improved luminous efficiency is made possible and/or some other angle control is achieved. Alternatively or additionally, the TIR collimator optical unit can have a multifaceted freeform shape at its exit surface.

In a further preferred embodiment, the conversion element is configured in a curved fashion. One element side can be embodied in a concave fashion and the other element side can be embodied in a convex fashion. In this case, the conversion element can be configured for example as a hemisphere or as a hemiellipsoid or as a semicylinder. Furthermore, it is conceivable for a reflector to be assigned to the element side embodied in a convex fashion. As a result of the concave configuration of the other element side, the radiation emerging from this element side is concentrated since a specific portion of the radiation emerging from this element side impinges again on a different section of this element side on account of the geometrical configuration. Said portion of the radiation is then either reflected toward an optical unit or penetrates into the conversion element again. There the radiation is then either converted ("recycled")—if this has not yet taken place—or, in the case of converted radiation, scattered. The radiation can then emerge from the convex or concave element side. A higher luminous efficiency can be achieved as a result of this configuration and as a result of the iterative process. For the radiation which emerges from the concave element side and impinges neither on the conversion element nor on the optical unit assigned to the concave element side, one further reflector or a plurality of further reflectors can be provided. Alternatively, the reflector assigned to the convex element side can be embodied in such a way that it also reflects this radiation. For this purpose, a lengthened reflector section can be provided, which can then additionally be designed with regard to the concave element side.

Advantageously, the conversion element is applied to a substrate which, in particular, is transparent and, in particular, has good thermal conductivity, such as sapphire, for example. The substrate can be embedded, for example adhesively bonded, in particular at the edges, into a holder, in particular into a metal holder. The holder or metal holder can be provided for heat dissipation. It is possible for the holder not to cover the substrate, or to cover it only in sections, on the substrate side facing away from the conversion element, in order that radiation emerging from the conversion element is not disturbed or blocked by the holder. The conversion element can thus be used as a 4Π sr emitter. Advantageously, a thickness of the substrate is minimized. Furthermore, contact areas between the mount and the substrate are advantageously minimized in order to prevent optical shading effects or in order to reduce optical disturbance effects as a result of the substrate. It is also conceivable to dispense with the substrate and to secure the conversion element directly, for example at the edge or edges thereof, on a holder or on a metal.

The holder can be embodied as an insert for an injection-molding tool. In this case, it is then advantageously arranged within a reflector in sections after the injection-molding method. In addition, it is conceivable to fit cooling ribs or cooling fins to the holder.

If one or a plurality of reflectors are provided, then the latter can be reflectively coated, for example have aluminum vapor-deposited thereon. That part of the holder which protrudes into the reflector and which also carries the conversion element can be further lengthened and/or widened and thus additionally used for reducing the optical "crosstalk" between at least two reflectors. It is also conceivable to use the holder as a horizontal shutter or shutter extending in the direction of travel. Furthermore, a front surface of the holder, said front surface facing, in particular, approximately in the direction of travel, can be used to accommodate additional elements such as auxiliary light sources or small optical units. Light functions such as, for example, flashing indicators and/or daytime running light can thereby be realized and supported.

As a result of the optical utilization of the natural 4Π sr emission of the conversion element, complex and expensive measures such as dichroic mirrors, recycling optical units, etc. become dispensable.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which:

FIGS. 16A and 16B show, in each case in a schematic illustration, a mount for a conversion element of the lighting device in accordance with one embodiment FIG. 17 shows, in a schematic illustration, the lighting device together with the mount in accordance with one embodiment

DETAILED DESCRIPTION

Figure 1:
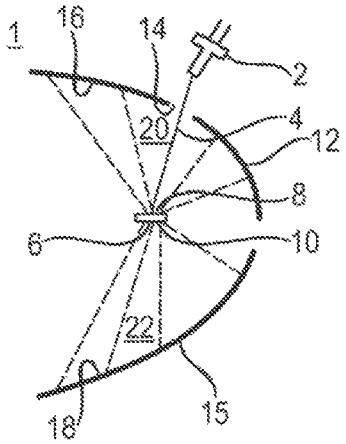
FIGS. 1 to 15 show, in each case in a schematic illustration, a remote phosphor lighting device in accordance with various embodiments

In accordance with FIG. 1, a remote phosphor lighting device is shown which is used in LARP technology and is referred to hereinafter as lighting device 1. The latter has a radiation source in the form of a laser light source 2, which irradiates a conversion element 6 with an excitation radiation 4. Said conversion element includes luminescent material (phosphor) which at least partly converts the excitation radiation. The conversion element has a first element side 8 and a second element side 10. Converted and non-converted radiation then emerges from the first and second element sides 8 and 10. The first element side 8 is assigned a reflector 12 having a radiation passage 14 for the excitation radiation 4. A further reflector 15 is assigned to the second element side 10. Consequently, the radiation emanating from the first element side 8 can be reflected via the reflector 12 and the reflector surface 16 thereof and the radiation emerging from the second element side 10 can be reflected via the reflector 15 and the reflector surface 18 thereof. The first element side 8 delimits a first radiation space 20 or half-space and the second element side 10 delimits a second radiation space 22 or half-space. The element sides 8 and 10 are embodied such that they are approximately planar and approximately parallel to one another. They extend approximately horizontally or approximately in a direction of travel of a vehicle using the lighting device 1. The reflectors 12, 15 then reflect the radiation emanating from the conversion element 6 approximately in the direction of travel.

Figure 2:
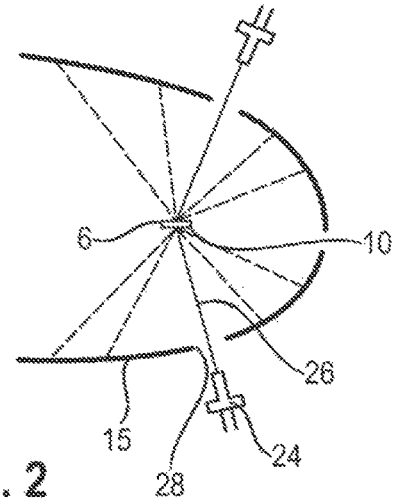

In accordance with FIG. 2, in contrast to the embodiment from FIG. 1, a further light source in the form of a laser light source 24 is provided, as a result of which the conversion element 6 can be illuminated uniformly. An excitation radiation of the conversion element 24 passes through a radiation passage 28 of the reflector 15 and impinges on the second element side 10 of the conversion element 6.

Figure 3:
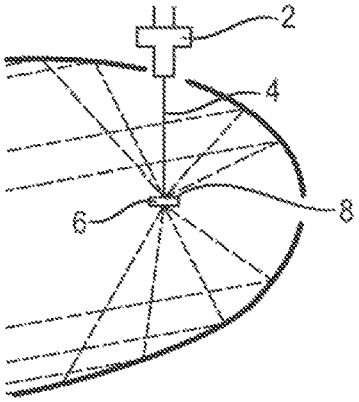

In FIG. 3, the conversion element 6 is arranged in a manner corresponding to FIGS. 1 and 2, but in this case, in contrast to the embodiments in FIGS. 1 and 2, the excitation radiation 4 of the laser light source 2 impinges on the first element side 8 approximately perpendicularly.

Figure 4:
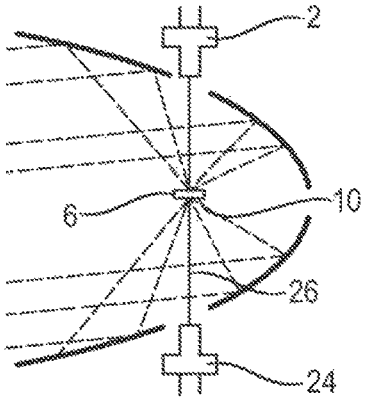

In accordance with FIG. 4, in contrast to FIG. 3, the further laser light source 24 is provided, wherein the excitation radiation 26 thereof likewise impinges on the second element side 10 of the conversion element 6 approximately perpendicularly. The laser light sources 2 and 24 are arranged approximately symmetrically with respect to one another in a manner corresponding to FIG. 2.

Figure 5:
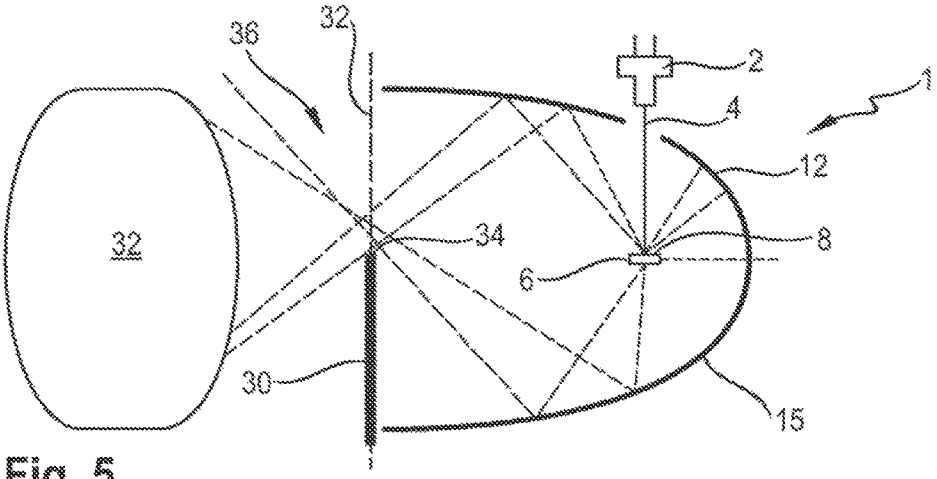

In FIG. 5, the reflectors 12 and 15 are connected or embodied integrally. The excitation radiation 4 of the single laser light source 2 impinges on the first element side 8 of the conversion element 6 approximately perpendicularly in a manner corresponding to FIG. 3. Furthermore, a shutter 30 is arranged, which is fixedly connected to the lighting device 1 and extends approximately in a vertical direction or approximately perpendicularly to the direction of travel. The shutter 30 lies in an intermediate plane 32 between the reflectors 12, 15 and a further optical unit in the form of a lens 32. The latter is disposed downstream of the reflectors 12 and 15. The shutter 30 is thus arranged in the beam path between the reflectors 12, 15 and the lens 32. An upper edge 34 of the shutter 30 as viewed approximately in a vertical direction serves as a bright-dark boundary. The reflectors 12 and 15 distribute the radiation emerging from the conversion element 6 in a near field 36. Downstream of the near field 36, the radiation is then distributed in a far field via the lens 32. The lighting device 1 in accordance with FIG. 5 can be used for example as low-beam light.

Figure 6:
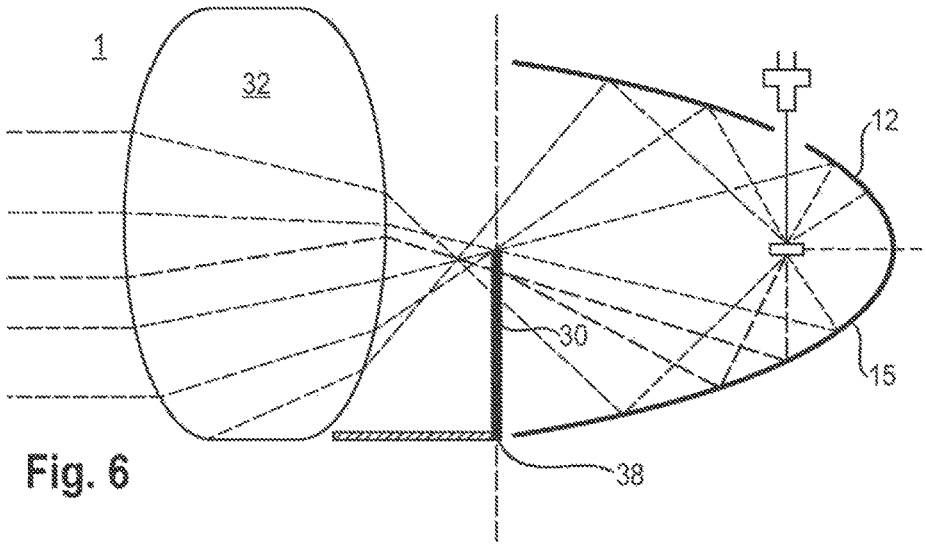

FIG. 6 shows the lighting device 1 in which the shutter 30 is pivotable about a pivoting axis 38. The shutter 30 can be pivoted at least into a first and a second position. In the first position, said shutter is arranged in sections in the beam path between the reflectors 12, 15 and the lens 32, as a result of which the lighting device 1 can be used as low-beam light. In the second position, the shutter 30 is pivoted out of said beam path, as a result of which the reflectors 12, 15 can reflect the radiation freely to the lens 32, and the lighting device 1 can be used for example as high-beam light.

Figure 7:
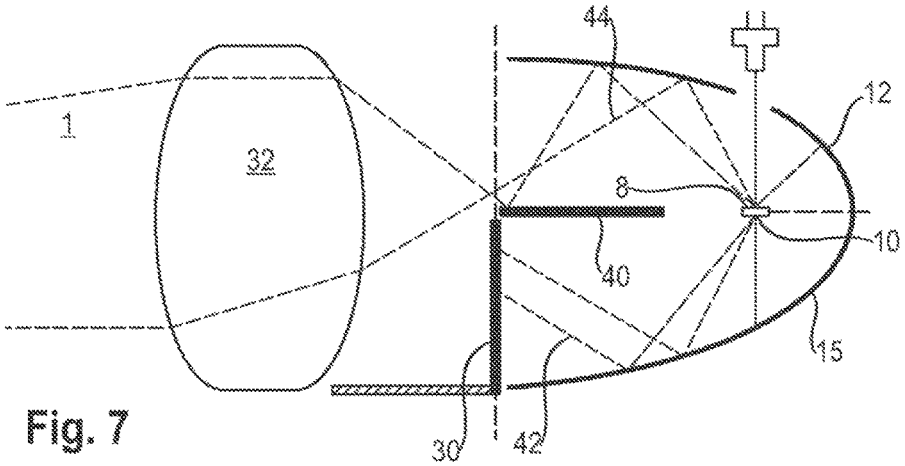

In accordance with FIG. 7, in contrast to FIG. 6, a shutter 40 is additionally provided, which shutter is firmly fixed in the lighting device 1 approximately in a horizontal direction or in the direction of travel. As a result, the radiation reflected by the reflectors 12, 15 can be separated from one another at least partly. The shutter 40 then delimits (a lower) radiation channel 42 in which substantially the radiation emanating from the second element side 10 and reflected by the reflector 15 radiates. The radiation channel 42 can then be opened and closed with control by the pivotable shutter 30. Furthermore, the shutter 40 delimits an (upper) radiation channel 44 for the radiation of the first element side 8. In the case of use as low-beam light, the radiation channel 42 is closed, as a result of which only radiation from the upper radiation channel 44 radiates to the lens 32. If the lighting device 1 is used as high-beam light, then the lower radiation channel 42 can be released by the shutter 30.

Figure 8:
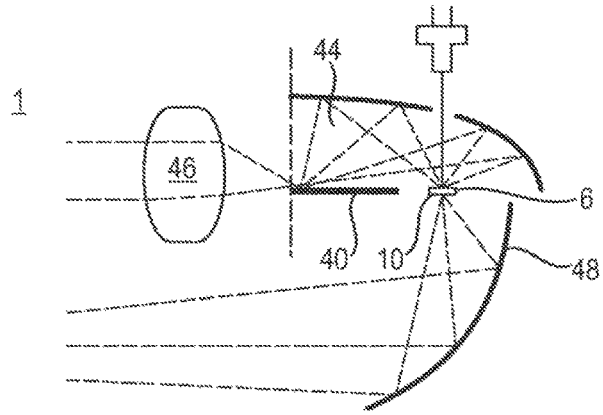

In accordance with FIG. 8, the lighting device 1 has only the shutter 40 arranged approximately horizontally. In this case, an optical unit embodied as a lens 46 is embodied in such a way that substantially the radiation of the upper radiation channel 44 radiates to the lens 46. A reflector 48 is provided for the radiation of the second element side 10 of the conversion element 6, which reflector then images the radiation directly in the far field. The reflector 48 is advantageously a multifaceted freeform reflector.

Figure 9:
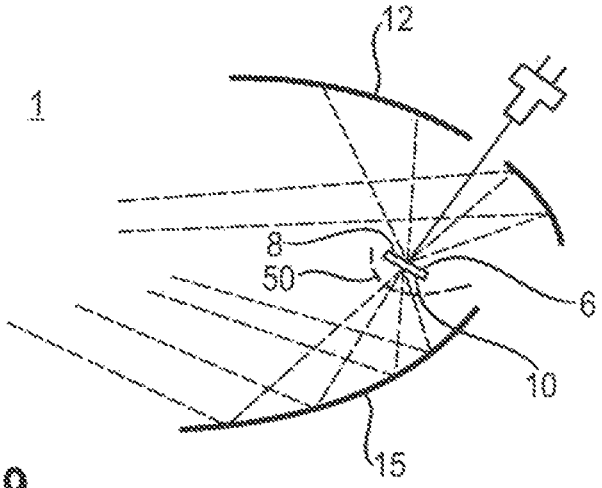

FIG. 9 shows the lighting device 1 in which the conversion element 6 is inclined relative to a horizontal plane or the direction of travel. In this case, the first element side 8 faces approximately away from a main beam direction of the lighting device 1 and the second element side 10 faces approximately in said main beam direction. The reflectors 12 and 15 reflect the radiation emanating from the element sides 8, 10 directly into a far field. The reflectors 12 and 15 can once again be multifaceted freeform surfaces. As a result of the inclination of the conversion element 6, the reflector 12 assigned to the first element side 8 can be irradiated more efficiently, wherein the radiation emanating from the first element side 8 can have a higher luminous flux proportion of the total luminous flux in comparison with the radiation emanating from the second element side 10. The radiation reflected by the reflector 12 can then be used for example as low-beam light. The radiation then reflected by the reflector 15, that is to say in particular the radiation of the second element side 10, can then serve for example in a supporting fashion as road sign illumination function or the reflectors 12 and 15 are used jointly for a high-beam light. For the use as high-beam light or low-beam light, a shutter 50 is then provided, which shutter is movable. For a low-beam light, the shutter 50 is then arranged in the beam path between the second element side 10 and the reflector 15. If the shutter 50 is reflective in this case, then the radiation emanating from the second element side 10 can be reflected to the reflector 12 and/or back to the conversion element 6. If the shutter 50 in this case is configured concavely with its side facing the conversion element 6, then the reflecting toward the conversion element 6 is improved. For the high-beam light, the shutter 50 is led out of the beam path between the second element side 10 and the reflector 15.

Figure 10:
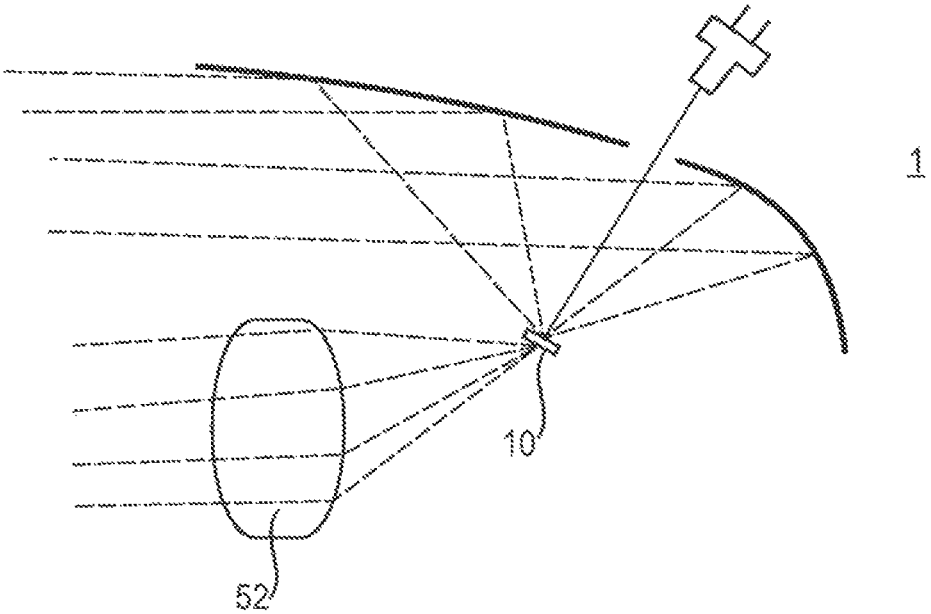

In accordance with FIG. 10, in contrast to FIG. 9, the lighting device 1 does not have a reflector 15 assigned to the second element side 10, but rather a refractive optical unit in the form of a lens 52. The shutter 50 from FIG. 9 can additionally be provided.

Figure 11:
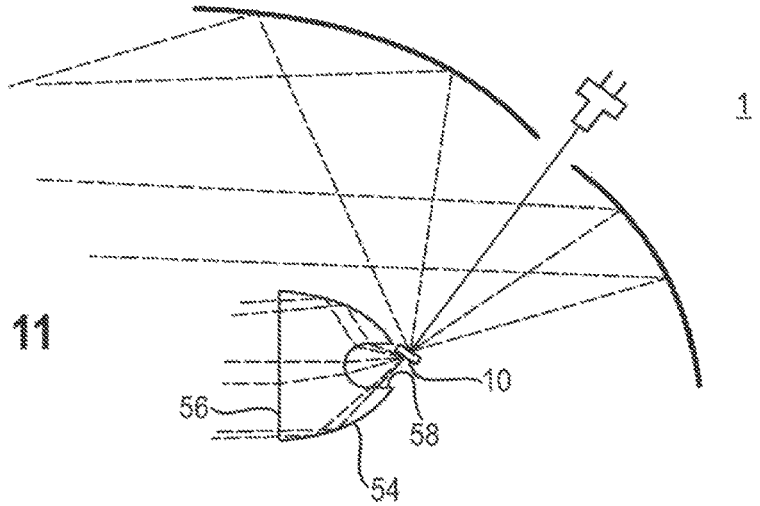

In FIG. 11, in contrast to FIG. 10, the lighting device 1 does not have a lens, but rather a TIR collimator optical unit 54. An exit surface 56 of the optical unit 54 is planar, curved or has a multifaceted freeform shape. An entrance surface 58 of the optical unit 54 is configured in a concave fashion and arranged adjacent to the second element side 10.

Figure 12:
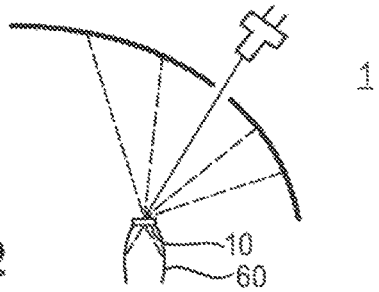

In accordance with FIG. 12, in contrast to FIG. 1, the lighting device 1, for the second element side 10, does not have a reflector 15, but rather a CPC (Compound Parabolic Concentrator) 60. The latter is arranged directly on the second element side 10 in accordance with FIG. 12 and can be used for downstream optical units or light functions (e.g. cornering light).

Figure 13:
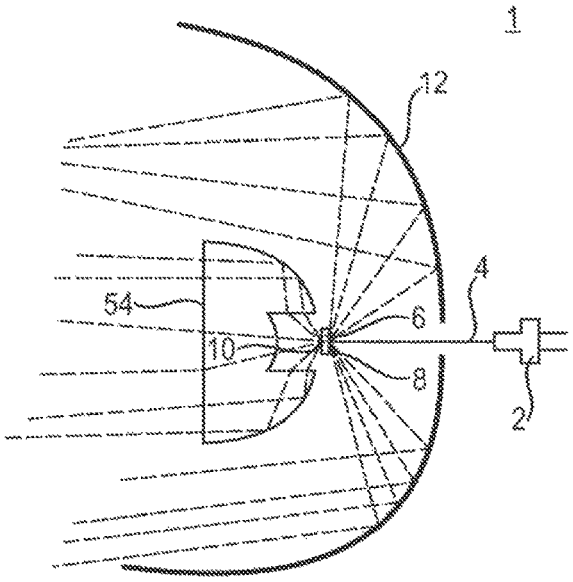

FIG. 13 shows the lighting device 1 in which the conversion element 6 extends approximately in a vertical direction or approximately perpendicularly to the direction of travel. In this case, surface normals of the element sides 8, 10 can then point approximately in the direction of travel. In this case, the first element side 8, which faces away from the direction of travel, for example, is assigned the reflector 12, which distributes the radiation directly in a far field. The other element side 10 is assigned the TIR collimator optical unit 54. The latter is arranged approximately centrally with respect to the reflector 12, as a result of which the latter can reflect the radiation emanating from the first element side 8 substantially in such a way that said radiation radiates past the optical unit 54. The laser light source 2 is arranged in such a way that the excitation radiation 4 impinges on the conversion element 6 approximately parallel to the surface normal of the first element side 8.

Figure 14:
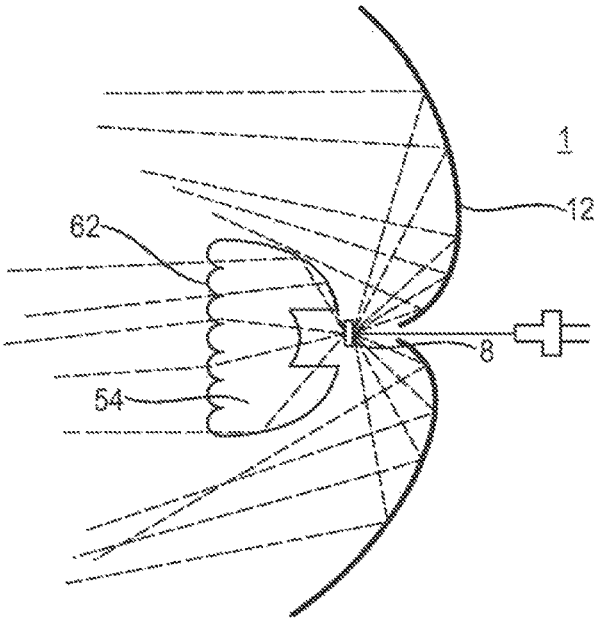

In accordance with FIG. 14, in contrast to FIG. 13, the lighting device 1 has a differently shaped reflector 12. The latter is configured approximately in a W-shaped fashion as viewed in cross section, as a result of which a larger portion of the radiation which emanates from the first element side 8 can radiate past the TIR collimator optical unit 54. Furthermore, the optical unit 54 has an exit surface 62 configured as a multifaceted freeform surface.

Figure 15:
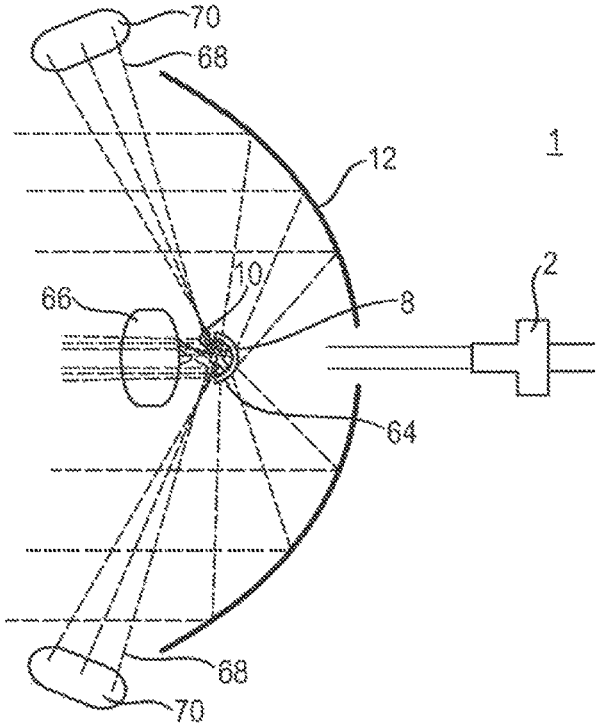

In FIG. 15, the lighting device 1 has a conversion element 64 configured in a curved fashion. The first element side 8 is configured in a convex fashion and the second element side 10 in a concave fashion. An axis of symmetry of the conversion element 64 points approximately in a direction of travel or extends approximately in a horizontal direction. Consequently, the first element side 8 substantially faces away from the direction of travel. The first element side 8 is assigned the reflector 12, which is configured for example as a multifaceted freeform reflector. The curved or concave second element side 10 concentrates the radiation emanating from it. Part of this radiation impinges on the downstream optical unit 66 and part is radiated back into the conversion element 8. Only radiation 68 which emanates from the second element side 10 and impinges neither on the conversion element 8 nor on the optical unit 66 cannot be used further. It is conceivable, however, to configure the reflector 12 in such a way that the latter can also reflect the radiation 68. Further reflectors 70 can also be provided for the radiation 68. The elements 70 could also include refractive optical units or the solid angle covered by the radiation 68 can be covered by a sensor element 70. The laser light source 2 is arranged in such a way that the excitation radiation 4 radiates onto the conversion element 64 approximately in the direction of the axis of symmetry of said conversion element.

FIG. 16A illustrates the mount of the conversion element 6. In this case, the conversion element 6 is applied to a transparent, thermally conductive substrate 72. In accordance with FIG. 16B, both the conversion element 6 and the substrate have an approximately rectangular cross section. In this case, the conversion element 6 is arranged approximately centrally with respect to the substrate 72 on the large side 74 thereof. The substrate 72 is then inserted into a holder 76. In the latter, the substrate 72 is supported at least in sections firstly by its circumferential wall 78 and secondly by its further large side 80. In this case, the holder 76 is configured in such a way that, in accordance with FIG. 16A, a central region 82 of the large side 80 is not covered by said holder. As a result, radiation emerging from the second element side 10 can radiate without hindrance to a downstream optical unit.

It would also be conceivable to secure the conversion element 6 directly in the holder 76.

FIG. 17 illustrates the holder 76 together with the reflectors 12 and 15. These can be produced together in an injection-molding method, wherein the holder 76 is then arranged as an insert in an injection-molding tool. In accordance with FIG. 17, the holder 76 has cooling ribs 84. It is conceivable for the section 86 of the holder 76 that projects into the reflectors 12, 15 to be used as a horizontal shutter; see FIG. 7, for example. Furthermore, it is conceivable to use an end face 88—facing in the direction of travel—of the holder 76 for arranging further elements, such as auxiliary light sources or small optical units, for example, or to realize or to support light functions such as a flashing indicator function and/or a daytime running light function, for example.

What is disclosed is a remote phosphor lighting device including an electromagnetic radiation source, with which a conversion element can be irradiated with an excitation radiation. The conversion element has two element sides. In this case, each element side is assigned an optical unit, by means of which the radiation emanating from the conversion element is coupled out.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device comprising:

an electromagnetic radiation source for irradiating a conversion element arranged in the lighting device with an excitation radiation, the conversion element having a first element side and a second element side, wherein the first element side delimits a first radiation space and the second element side delimits a second radiation space, at least one optical unit at least for part of the radiation emanating from the first element side arranged in the first radiation space, at least one optical unit at least for part of the radiation emanating from the second element side is arranged in the second radiation space, and at least a first shutter arranged in a beam path of radiation; wherein the first shutter is pivotable about a pivoting axis arranged in a plane parallel to the conversion element.

2. The lighting device as claimed in claim 1, wherein the radiation emanating from the element sides is coupled out by means of the optical units.

3. The lighting device as claimed in claim 1, wherein the excitation radiation of the radiation source radiates onto the first element side, and wherein a second radiation source is provided, the excitation radiation of which radiates onto the second element side.

4. The lighting device as claimed in claim 1, wherein a reflector having an optical reflector surface is respectively provided as optical unit for each of a respective element side.

5. The lighting device as claimed in claim 4, wherein the first shutter is arranged in the beam path of at least part of the radiation reflected by one of the respective reflectors or which is arranged in the beam path of at least part of the radiation reflected by both of said reflectors.

6. The lighting device as claimed in claim 5, wherein the first shutter can be introduced into and withdrawn from the beam path.

7. The lighting device as claimed in claim 5, wherein a second shutter is provided, which is arranged at least in sections in the beam path between one of said reflectors assigned to the first element side and the first shutter, wherein the first shutter can be arranged in the beam path of at least part of the radiation emanating from the other of said reflectors.

8. The lighting device as claimed in claim 7, wherein the first shutter or the second shutter is arranged in such a way that it substantially separates the respective radiations emanating from the reflector.

9. The lighting device as claimed in claim 4, wherein the conversion element is inclined relative to a horizontal plane and/or relative to one or both reflector surfaces and/or relative to a direction of travel of a vehicle using the lighting device.

10. The lighting device as claimed in claim 1, wherein a surface normal of the first element side is approximately parallel to the excitation radiation of the assigned radiation source, and/or wherein a surface normal of the second element side is approximately parallel to the excitation radiation of the assigned radiation source.

11. The lighting device as claimed in claim 1, wherein one optical unit is a reflector and the other optical unit is a lens or a TIR (Total Internal Reflection) collimator optical unit or a CPC (Compound Parabolic Concentrator) optical unit.

12. The lighting device as claimed in claim 1, wherein an angle rotator is provided for the emanating radiation of the first and/or the second element side.

13. The lighting device as claimed in claim 1, wherein a surface normal of the element sides points approximately in a direction of travel of a vehicle using the lighting device, wherein a reflector is provided at least for part of the radiation emanating from one element side, and wherein another optical unit is provided at least for part of the radiation emanating from the other element side.

14. The lighting device as claimed in claim 1, wherein the conversion element is curved.

15. The lighting device as claimed in claim 1, wherein the conversion element is applied to a transparent substrate which is held by a holder, or wherein the conversion element is mounted directly on a holder.

* * * * *